US010636345B2

(12) United States Patent
Jia et al.

(10) Patent No.: US 10,636,345 B2
(45) Date of Patent: Apr. 28, 2020

(54) METHOD OF COMPENSATING IN DISPLAY PANEL, DRIVING UNIT AND DISPLAY PANEL

(71) Applicants: Chengdu BOE Optoelectronics Technology Co., Ltd., Chengdu (CN); BOE Technology Group Co., Ltd., Beijing (CN)

(72) Inventors: Qun Jia, Beijing (CN); Yong Yu, Beijing (CN); Chuanyan Lan, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/378,785

(22) Filed: Apr. 9, 2019

(65) Prior Publication Data

US 2020/0098302 A1 Mar. 26, 2020

(30) Foreign Application Priority Data

Sep. 25, 2018 (CN) ..... 2018 1 1119430

(51) Int. Cl.
*G09G 3/20* (2006.01)

(52) U.S. Cl.
CPC ... *G09G 3/2007* (2013.01); *G09G 2320/0233* (2013.01)

(58) Field of Classification Search
CPC ..... G09G 3/2007; G09G 2320/0233
See application file for complete search history.

(56) References Cited

U.S. PATENT DOCUMENTS

| | | | |
|---|---|---|---|
| 9,715,716 | B2 | 7/2017 | Song et al. |
| 9,847,056 | B2 | 12/2017 | Shimizu et al. |
| 2015/0379683 | A1 | 12/2015 | Song et al. |
| 2016/0093248 | A1 | 3/2016 | Shimizu et al. |

(Continued)

FOREIGN PATENT DOCUMENTS

| | | | |
|---|---|---|---|
| CN | 102800288 | A | 11/2012 |
| CN | 105027551 | A | 11/2015 |

(Continued)

OTHER PUBLICATIONS

First Office Action, including Search Report, for Chinese Patent Application No. 201811119430.X , dated Jan. 2, 2020, 15 pages.

*Primary Examiner* — Sejoon Ahn
(74) *Attorney, Agent, or Firm* — Westman, Champlin & Koehler, P.A.

(57) ABSTRACT

The present disclosure provides a method of compensating in a display panel, comprising: determining a displaying state according to a displaying state parameter of the display panel; acquiring a reference compensation parameter and a correction coefficient for a target displaying state, in response to determining that the displaying state is the target displaying state; determining a corrected compensation parameter for the target displaying state, based on the reference compensation parameter and the correction coefficient for the target displaying state; and compensating display brightness of pixels on the display panel, by using the corrected compensation parameter.

9 Claims, 4 Drawing Sheets

(56) References Cited

U.S. PATENT DOCUMENTS

| | | | | |
|---|---|---|---|---|
| 2016/0165229 | A1* | 6/2016 | Kao | H04N 17/04 348/189 |
| 2016/0170236 | A1* | 6/2016 | Whitehead | H04N 9/3126 362/97.1 |
| 2016/0171916 | A1* | 6/2016 | Buckley | G09G 3/2003 345/692 |
| 2016/0171923 | A1* | 6/2016 | Chaji | G09G 3/2003 345/690 |
| 2016/0171939 | A1* | 6/2016 | Na | G09G 3/20 345/690 |
| 2016/0173862 | A1* | 6/2016 | Huang | G09G 3/2003 348/51 |
| 2016/0173866 | A1* | 6/2016 | Kim | G09G 3/003 345/694 |
| 2016/0180760 | A1* | 6/2016 | Hochman | H04N 9/73 345/694 |
| 2016/0180765 | A1* | 6/2016 | Hwang | G09G 3/20 345/690 |
| 2017/0011683 | A1 | 1/2017 | Bae et al. | |
| 2018/0151109 | A1 | 5/2018 | Shim et al. | |

FOREIGN PATENT DOCUMENTS

| | | | |
|---|---|---|---|
| CN | 106373516 | A | 2/2017 |
| CN | 108109583 | A | 6/2018 |
| CN | 108335677 | A | 7/2018 |
| CN | 108492776 | A | 9/2018 |
| EP | 2961164 | B1 | 6/2018 |

* cited by examiner

METHOD OF COMPENSATING IN DISPLAY PANEL, DRIVING UNIT AND DISPLAY PANEL

CROSS-REFERENCE TO RELATED APPLICATION(S)

This application claims the priority of Chinese Patent Application No. 201811119430.X, filed on Sep. 25, 2018, the entire contents of which are hereby incorporated by reference.

TECHNICAL FIELD

Embodiments of the present disclosure relate to the field of display technologies, and in particular, to a method of compensating in a display panel, a driving unit and a display panel.

BACKGROUND

When fabricating thin film transistors (TFT) on a glass substrate, the TFTs at different positions generally have non-uniformity in electrical parameters such as threshold voltage, mobility, and the like, due to non-uniformity in a fabrication process or parameter drifts resulted from being at high temperature and high pressure for a long time. This non-uniformity may be translated into current differences and brightness differences in a display device, which will be perceived by human eyes. Therefore, it is necessary to solve this non-uniform phenomenon by designing various compensation techniques. The compensation methods are generally divided into internal compensation methods and external compensation methods.

SUMMARY

The present disclosure provides a method of compensating in a display panel, comprising: determining a displaying state according to a displaying state parameter of the display panel; acquiring a reference compensation parameter and a correction coefficient for a target displaying state, in response to determining that the displaying state is the target displaying state; determining a corrected compensation parameter for the target displaying state, based on the reference compensation parameter and the correction coefficient for the target displaying state; and compensating display brightness of pixels on the display panel, by using the corrected compensation parameter.

For example, the displaying state parameter comprises a refresh rate.

For another example, acquiring the reference compensation parameter and the correction coefficient for a target displaying state comprises: fetching the reference compensation parameter and the correction coefficient from a storage unit of the display panel.

For another example, acquiring the reference compensation parameter comprises: capturing an image displayed on the display panel under the reference displaying state; determining positions to be compensated based on the image; determining the reference compensation parameter for each of the positions to be compensated; and storing the reference compensation parameter.

For another example, the acquiring the correction coefficient for the target displaying state further comprises: selecting N representative display panels from a plurality of display panels having the same production batch as the display panel, wherein N being an integer greater than one; determining the reference compensation parameter for each of the N representative display panels, under a reference displaying state; determining a target compensation parameter for each of the N representative display panels, under the target displaying state; and acquiring the correction coefficient for the target displaying state via a fitting operation, according to the reference compensation parameters and the target compensation parameters for the N representative display panels.

For another example, acquiring the correction coefficient for the target displaying state via the fitting operation further comprises: performing the fitting operation to acquire the correction coefficients c, d, e, and f, by:

$$a_{ij}'=c\cdot a_{ij}+d,\ b_{ij}'=e\cdot b_{ij}+f$$

wherein, $a_{ij}$ and $b_{ij}$ are the reference compensation parameters at a $j^{th}$ position to be compensated on an $i^{th}$ representative display panel among the N representative display panels determined under the reference displaying state, i is an integer being greater than or equal to 1 and being less than or equal to N, j is an integer being greater than or equal to 1; $a_{ij}'$ and $b_{ij}'$ are the target compensation parameters at the $j^{th}$ position to be compensated on the $i^{th}$ representative display panel among the N representative display panels determined under the target displaying state.

For another example, determining the corrected compensation parameter for the target displaying state based on the reference compensation parameter and the correction coefficient comprises: determining, for respective position to be compensated on the display panel, the corrected compensation parameters a' and b' for the target displaying state, by:

$$a'=c\cdot a+d,\ b'=e\cdot b+f$$

wherein a and b are the reference compensation parameters for the respective position to be compensated.

For another example, compensating display brightness of pixels on the display panel, by using the corrected compensation parameter comprises: compensating the display brightness for the respective position to be compensated by:

$$y=a_j'\cdot x+b_j'$$

wherein x is an input gray scale value, y is an output gray scale value, and $a_j$ and $b_i$ are the corrected compensation parameters at the $j^{th}$ position to be compensated on the display panel.

According to another aspect of the present disclosure, there is provided a driving unit for a display panel, comprising: a memory configured to store instructions; at least one processor coupled to the memory electrically and configured to execute instructions stored in the memory to:

determine a displaying state according to a displaying state parameter of the display panel;

acquire a reference compensation parameter and a correction coefficient for a target displaying state, in response to determining that the displaying state is the target displaying state;

determine a corrected compensation parameter for the target displaying state, based on the reference compensation parameter and the correction coefficient for the target displaying state; and compensate display brightness of pixels on the display panel, by using the corrected compensation parameter.

For example, the processor is further configured to acquire the correction coefficient for the target displaying state in advance by:

selecting N representative display panels from a plurality of display panels having the same production batch as the display panel, wherein N being an integer greater than one;

determining the reference compensation parameter for each of the N representative display panels, under a reference displaying state;

determining a target compensation parameter for each of the N representative display panels, under the target displaying state; and acquiring the correction coefficient for the target displaying state via a fitting operation, according to the reference compensation parameters and the target compensation parameters for the N representative display panels.

For another example, the processor is further configured to perform the fitting operation to acquire the correction coefficients c, d, e, and f, by:

$$a_{ij}'=c\cdot a_{ij}+d,\ b_{ij}'=e\cdot b_{ij}+f$$

wherein, $a_{ij}$ and $b_{ij}$ are the reference compensation parameters at a $j^{th}$ position to be compensated on an $i^{th}$ representative display panel among the N representative display panels determined under the reference displaying state, i is an integer being greater than or equal to 1 and being less than or equal to N, j is an integer being greater than or equal to 1; $a_{ij}'$ and $b_{ij}'$ are the target compensation parameters at the $j^{th}$ position to be compensated on the $i^{th}$ representative display panel among the N representative display panels determined under the target displaying state.

For another example, the processor is further configured to determine, for respective position to be compensated on the display panel, the corrected compensation parameters a' and b' for the target displaying state, by:

$$a'=c\cdot a+d,\ b'=e\cdot b+f$$

wherein a and b are the reference compensation parameters for the respective position to be compensated.

For another example, the processor is further configured to compensate the display brightness for the respective position to be compensated, by:

$$y=a_j'\cdot x+b_j'$$

wherein x is an input gray scale value, y is an output gray scale value, and $a_j$ and $b_j$ are the corrected compensation parameters at the $j^{th}$ position to be compensated on the display panel.

For another example, the processor is further configured to:

capture an image displayed on the display panel under the reference displaying state;

determine positions to be compensated based on the image;

determine the reference compensation parameter for each of the positions to be compensated; and store the reference compensation parameter.

For another example, the processor is further configured to fetch the reference compensation parameter and the correction coefficient from a storage unit of the display panel.

According to yet another aspect of the present disclosure, there is provided a driving unit for a display panel, comprising:

a module for displaying state determination, configured to determine a displaying state according to a displaying state parameter of the display panel;

a parameter acquisition module, configured to acquire a reference compensation parameter and a correction coefficient for a target displaying state, in response to determining that the displaying state is the target displaying state;

a correction module, configured to determine a corrected compensation parameter for the target displaying state, based on the reference compensation parameter and the correction coefficient for the target displaying state; and a driving circuit, configured to compensate display brightness of pixels on the display panel, by using the corrected compensation parameter.

For example, the parameter acquisition module is further configured to acquire the correction coefficient for the target displaying state in advance by:

selecting N representative display panels from a plurality of display panels having the same production batch as the display panel, wherein N being an integer greater than one;

determining the reference compensation parameter for each of the N representative display panels, under a reference displaying state;

determining a target compensation parameter for each of the N representative display panels, under the target displaying state; and acquiring the correction coefficient for the target displaying state via a fitting operation, according to the reference compensation parameters and the target compensation parameters for the N representative display panels.

For another example, the parameter acquisition module is further configured to perform the fitting operation to acquire the correction coefficients c, d, e, and f, by:

$$a_{ij}'=c\cdot a_{ij}+d,\ b_{ij}'=e\cdot b_{ij}+f$$

wherein, $a_{ij}$ and $b_{ij}$ are the reference compensation parameters at a $j^{th}$ position to be compensated on an $i^{th}$ representative display panel among the N representative display panels determined under the reference displaying state, i is an integer being greater than or equal to 1 and being less than or equal to N, j is an integer being greater than or equal to 1; $a_{ij}'$ and $b_{ij}'$ are the target compensation parameters at the $j^{th}$ position to be compensated on the $i^{th}$ representative display panel among the N representative display panels determined under the target displaying state.

For another example, the parameter acquisition module is further configured to determine, for respective position to be compensated on the display panel, the corrected compensation parameters a' and b' for the target displaying state, by:

$$a'=c\cdot a+d,\ b'=e\cdot b+f$$

wherein a and b are the reference compensation parameters for the respective position to be compensated.

According to still another aspect of the disclosure, there is provided a display device comprising: a display panel; and the driving unit of any of the above embodiments, wherein the driving unit is connected to the display panel electrically.

DETAILED DESCRIPTION

Figure 1:
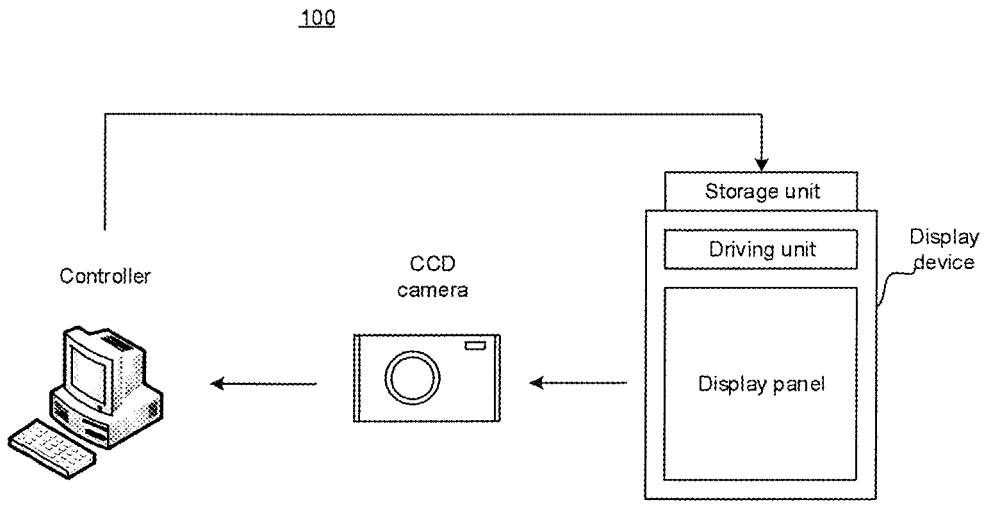
FIG. 1 shows a schematic structural view illustrating an optical compensation system for a display panel.

To make the objectives, technical solutions, and advantages of the embodiments of the present disclosure more comprehensible, the technical solutions in the embodiments of the present disclosure will be described clearly and completely below with reference to the accompanying drawings in the embodiments of the present disclosure. Obviously, the described embodiments are only a part but not all of the embodiments of the present disclosure. All other embodiments obtained by those skilled in the art based on the described embodiments of the present disclosure without creative efforts shall also fall within the scope of the present disclosure. It should be understood that the same elements are denoted by the same or similar reference numerals throughout the drawings. In the following description, the specific embodiments are for illustrative purposes only, and are not to be construed as limiting the disclosure. Conventional structures or configurations will be omitted in order to not confuse the understanding of the present disclosure. It should be also noted that the shapes and sizes of the various components in the figures do not reflect a true size and proportion, but merely illustrate contents of the embodiments of the present disclosure.

Technical or scientific terms used in the embodiments of the present disclosure should be of ordinary meaning as understood by those skilled in the art, unless otherwise defined. The terms "first", "second" and similar words used in the embodiments of the present disclosure do not denote any order, quantity, or importance, but are merely used to distinguish different components.

It should be noted that pixel brightness compensation discussed herein may be a compensation for brightness unevenness of the display panel, a compensation for color unevenness of the display panel, or a combination thereof. Essentially, the color unevenness is caused by the brightness unevenness of sub-pixels. Therefore, in the following embodiments of the present application, the description is generally made by taking the compensation for the brightness unevenness as an example, but the present disclosure is not limited thereto.

External compensation methods for the pixel brightness may comprise optical external compensation methods and electrical external compensation methods, wherein the optical external compensation methods can be also referred to as Demura technology. The Demura technology may comprise extracting a brightness signal via technologies such as optical CCD photography and the like after the display panel emits light, identifying mura (i.e., brightness or color difference) data according to associated algorithms, and generating Demura data according to corresponding algorithms, and burning the Demura data into a memory device such as a FLASH ROM, so as to achieve a compensation effect. Since conventional Demura technologies only take the case that the refresh frequency is a fixed value (for example, 60 Hz) into account, only the Demura data with a refresh frequency of 60 Hz may be burned in the FLASH ROM. However, since the same display panel may need to be used under different refresh rates, for example, AR, VR, etc. require a refresh rate of 90 Hz or 120 Hz, and Demura data at different refresh frequencies are not the same, it is necessary to determine Demura data at other refresh rates. This leads to a complicated process, an increase in occupied storage space, and an increase in cost.

The present disclosure will be described in detail below with reference to the accompanying drawings.

FIG. 1 shows a schematic structural view illustrating an optical compensation system for a display panel.

As shown in FIG. 1, the optical compensation system 100 includes a controller, an image acquisition unit (e.g., a CCD camera) and a display device. The display device includes a display panel, a driving unit, and a storage unit (e.g., a FLASH ROM). According to an embodiment of the present disclosure, the display panel may be an AMOLED panel or other types of display panels, but not limit to this. Moreover, although the storage unit in FIG. 1 is shown as being external to the driving unit, those skilled in the art will appreciate that the functionality of the storage unit can also be implemented by a memory included in the driving unit.

According to an embodiment of the present disclosure, the driving unit is capable of receiving a command from outside (e.g., a processor) and calling drive data stored in the storage unit so as to drive the display panel. The drive data can include displaying state parameters. In one embodiment, the displaying state parameter may be display refresh rate, such as 60 Hz, 90 Hz, or 120 Hz. Although the present disclosure is described by taking the display refresh rate as the displaying state parameter, it should be understood that in other embodiments, other parameters may also be used as the displaying state parameter. Those skilled in the art will appreciate that the driving unit itself may also include a processor to perform a compensation method in accordance with an embodiment of the present disclosure.

A reference display refresh rate, for example, 60 Hz, can be selected based on the display refresh rate. Further, a state in which the display panel is displayed at a reference display refresh rate may be referred to as a reference displaying state. Under any displaying state comprising the reference displaying state, the display panel can be driven to display respective gray scales having gray values from 0-255.

The driving unit may further include a driving circuit such as a gate driving circuit, a source driving circuit and the like.

The CCD camera may capture an image displayed on the display panel under the displaying state, so as to obtain image data of a display picture. For example, the CCD camera can take the image for the display panel displaying respective gray scales, so as to obtain the image data for respective gray scale pictures.

The CCD camera with high precision and high resolution is generally employed. The resolution of the CCD camera may be determined based on the resolution, size, shooting distance and preset Demura compensation accuracy of the display panel. For example, the Demura compensation accuracy may generally be 1×1 pixel, 2×2 pixels, 3×3 pixels, etc. After determining the compensation accuracy, the resolution of the CCD camera should be determined to be more precise than the compensation accuracy.

The CCD camera may send the image data to a processor for processing. The processor may firstly analyze the distribution characteristics of the image data, and then identifies uneven brightness (i.e., mura) according to an associated algorithm. In particular, mura can be identified in a variety of ways, for example, by any method based on the GFPDF or IDMS standards, which are not limited herein.

It should also be noted that the identified mura data on the same panel may vary depending on different gray scales. In one embodiment, image data at different gray scales may be processed (e.g., averaged) to obtain image data that will be used for subsequent identification process of the mura data.

Then, based on the identified mura data, the processor determines the Demura compensation parameter (i.e., an optical compensation parameter) according to the Demura compensation algorithm. In general, the principle of the Demura compensation algorithm is to brighten areas that are considered to be dark and to darken areas that are considered to be bright, so as to have substantially the same brightness for each area on the display panel.

In some embodiments, a linear compensation algorithm is employed. The linear compensation algorithm is described below as an example. Specifically, with respect to a certain compensation accuracy, the compensation for any unit area (or position) that requires a mura compensation can be expressed by:

$$y=a_j \cdot x+b_j$$

$$y=a_j \cdot x+b_j$$

wherein x is an input gray scale value, y is an output gray scale value, and $a_j$ and $b_j$ are gain parameter and deviation parameter at the $j^{th}$ unit area to be compensated on the display panel respectively, which can be collectively referred to as compensation parameter, and wherein j is an integer greater than or equal to 1.

After determining the compensation parameter, the processor can be further configured to write (e.g., burn) the compensation parameter into the storage unit in the display device. Thus, the driving unit can fetch the compensation parameter from the storage unit and drive the display panel after compensating in the display panel accordingly, so that the display panel is enabled to display the Demura compensated pictures.

Generally, after the display panels having the same production batch are produced, Demura operation is required for each display panel having the production batch. The Demura operation is performed under the reference displaying state (for example, a refresh rate of 60 Hz). Then, the determined Demura compensation parameters are separately burned into the storage units of the corresponding display devices. Therefore, the Demura compensation parameter under the reference displaying state is stored in the storage unit. However, in some cases (e.g., the cases that the display device is used for AR or VR display), the display panel does not operate at a refresh rate of, for example, 60 Hz, but operates at a refresh rate of 90 Hz or 120 Hz. At different refresh rates, the position of Mura does not change, but the brightness difference between different brightnesses will be different. Therefore, if the Demura compensation parameter under the reference displaying state which is stored in the storage unit is still used for compensation, it is difficult to achieve a satisfying compensation effect. However, if the Demura operation is repeatedly performed for a plurality of displaying states, and the compensation parameters obtained in each displaying state are stored in the storage unit, the number of process will be greatly increased, and a large storage capacity will be required, increasing the cost.

Figure 2:
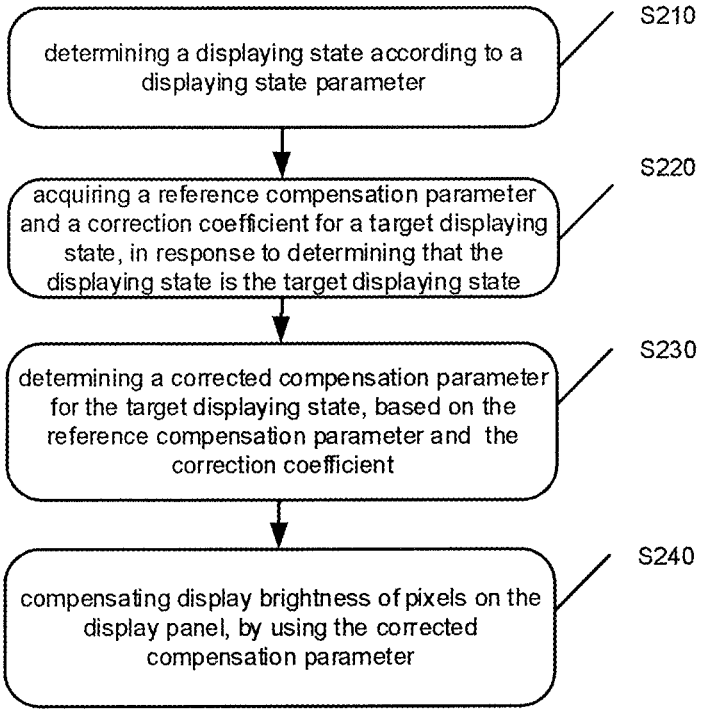
FIG. 2 shows a flow chart illustrating a method of compensating in a display panel in accordance with an embodiment of the present disclosure.

FIG. 2 shows a flow chart illustrating a method 200 of compensating in a display panel in accordance with an embodiment of the present disclosure. As shown in FIG. 2, the method 200 includes steps S210-S240. It should be noted that the serial numbers of the respective steps in the following method are only as a representation of the steps for description, and should not be regarded as indicating the execution order of the respective steps. This method does not need to be performed exactly as shown, unless explicitly stated. In step S210, the displaying state is determined according to the displaying state parameter of the display panel.

In some embodiments, the displaying state parameter includes a refresh rate. For example, the value of the refresh rate set in the system can be read out. As described above, when the refresh rate is 60 Hz, the target displaying state can be determined as the reference displaying state, and when the refresh rate is 90 or 120 Hz, the target displaying state can be determined as a special displaying state, such as a VR/AR displaying state.

In step S220, a reference compensation parameter and a correction coefficient for the target displaying state may be acquired in response to determining that the displaying state is the target displaying state.

In some embodiments, the reference compensation parameters and the correction coefficients for different target displaying states may be pre-stored in the storage unit corresponding to the display panel (i.e., the storage unit and the display panel belong to the same display device). Thus, it is enabled to fetch the corresponding reference compensation parameters and the corresponding correction coefficients from the storage unit in response to determining the target display.

In some embodiments, the reference compensation parameter and the correction coefficient may be predetermined by a predetermined step.

The determination process of the reference compensation parameter has been described above in connection with FIG. 1. Specifically, in one embodiment, acquiring the reference compensation parameter in advance may comprise:

capturing an image displayed on the display panel under the reference displaying state (which may be a plurality of gray scale images);

determining positions to be compensated based on the image (which may be an average position determined for the plurality of gray scale images);

determining the reference compensation parameter $a_j$ and $b_j$ for each of the positions to be compensated.

Those skilled in the art should understand that if it is determined in step S210 that the displaying state of the display panel is the reference displaying state, the reference compensation parameter $a_j$ and $b_j$ can be used to compensate the display brightness of pixels, in particular, by $y=a_j \cdot x+b_j$, wherein x is the input gray scale value and y is the output gray scale value.

A specific example of acquiring the correction coefficient for the target displaying state according to an embodiment of the present disclosure will be described below.

The term of "correction" refers to correcting the reference compensation parameter for the reference displaying state when changing from the reference displaying state to another displaying state, so as to apply the corrected compensation parameter (i.e., the corrected compensation parameter) for the changed displaying state.

Those skilled in the art should understand that the embodiments of the present disclosure are based on the following recognition: (1) for the same display panel, the positions to be compensated are the same under different displaying states (or refresh rates); (2) for the same position to be compensated on the same display panel, the compensation parameters for different displaying states (or refresh rates) are different, but have a certain linear relationship with each other, wherein such a linear relationship is at least applicable to all display panels having the same production batch. Thereby, the correction coefficient for the target displaying state can be acquired (fitted) in advance based on the reference compensation parameters for the reference displaying state and the target compensation parameters for the target displaying state of the plurality of display panels having the same production batch.

There may be a plurality of display panels having the same production batch as the presently concerned display panel. If the changes in the compensation parameter for the plurality of display panels of the same production batch due to the changes of the refresh rate satisfy the same correction function (i.e., a transformation function), the correction coefficient in the correction function for the display panels of the same production batch can be determined (fitted) based on N representative display panels (N is greater than 1, but much less than the total number of display panels of the production batch), thereby determining the correction function. Then, the corrected compensation parameter can be derived from the reference compensation parameter by using the determined correction coefficient.

In some embodiments, the N representative display panels may be selected randomly or specified according to certain rules or preferences.

After selecting the N representative display panels, firstly, the reference compensation parameters $a_{ij}$ and $b_{ij}$ for each of the N representative display panels may be determined under a reference displaying state (for example, a refresh rate of 60 Hz), wherein, $a_{ij}$ and $b_{ij}$ are the reference compensation parameters at a $j^{th}$ position to be compensated on an $i^{th}$ representative display panel among the N representative display panels determined under the reference displaying state, i is an integer being greater than or equal to 1 and being less than or equal to N. In some embodiments, this process may have been implemented in a previous step (see FIG. 1). Therefore, it is only required to fetch the reference compensation parameters herein.

Then, under the target displaying state (e.g., at a refresh rate of 90 Hz), the target compensation parameters $a_{ij}'$ and $b_{ij}'$ may be determined for each of the N representative display panels, wherein $a_{ij}'$ and $b_{ij}'$ are the target compensation parameters at the $j^{th}$ position to be compensated on the $i^{th}$ representative display panel among the N representative display panels determined under the target displaying state.

Next, the correction coefficient for the target displaying state may be fitted, according to the reference compensation parameters ($a_{ij}$ and $b_{ij}$) and the target compensation parameters ($a_{ij}'$ and $b_{ij}'$) for the N representative display panels.

According to the reference compensation parameters ($a_{ij}$ and $b_{ij}$) and the target compensation parameters ($a_{ij}'$ and $b_{ij}'$), a plurality of ($a_{ij}$, $a_{ij}'$) data sets and a plurality of (bij, bij') data sets can be obtained. A fitting operation can be performed on the correction coefficients, by using these data sets.

In some embodiments, based on the recognition that "the compensation parameters for different displaying states (or refresh rates) have a certain linear relationship with each other", the correction coefficients c, d, e, and f can be acquired by using a linear fitting operation as follows:

$$a_{ij}'=c\cdot a_{ij}+d,\ b_{ij}'=e\cdot b_{ij}+f$$

wherein the coefficients c, d, e, and f to be fitted are the correction coefficients.

It should be understood that the linear fitting algorithm employed in the present application is merely an example, and in other embodiments, other algorithms may be used for fitting. In addition, those skilled in the art can understand that in the above linear fitting operation, the least squares meaning can be used as the deviation metric between the sample points (aij, aij'), (bij, bij') and the fitted line. Certainly, other metrics can be used. In addition, those skilled in the art can understand that the more the sample points are, the closer the fitting result will get to an ideal value, and the heavier the calculation will be. A compromise may be worked out between the accuracy and the calculation amount according to an actual application.

After the correction coefficients c, d, e, and f are determined, these correction coefficients can be stored in the storage unit for being fetched in the future.

In step S230, a corrected compensation parameter for the target displaying state is determined based on the reference compensation parameter and the correction coefficient.

After fetching the reference compensation parameter and the correction coefficient from the storage unit, the corrected compensation parameter for the target displaying state can be derived with respect to the display panels of this production batch. For example, for any position to be compensated on any of the display panels, if the reference compensation parameters are a and b, and the correction coefficients are c, d, e, and f, the corrected compensation parameters a' and b' for the target displaying state are as follows:

$$a'=c\cdot a+d,\ b'=e\cdot b+f.$$

In step S240, the display brightness of pixels on the display panel may be compensated by using the corrected compensation parameter.

For example, for each of positions to be compensated on the display panel, the display brightness is compensated by:

$$y=a_j'\cdot x+b_j'$$

wherein x is an input gray scale value, y is an output gray scale value, and $a_j$ and $b_j$ are the corrected compensation parameters at the $j^{th}$ position to be compensated on the display panel.

Thus, the driving unit is capable of compensating for the brightness (i.e., gray scale) of the pixels (or sub-pixels) that need to be compensated by using the corrected compensation parameters, so that each pixel of the display panel achieves a more uniform display under the target displaying state.

Figure 3:
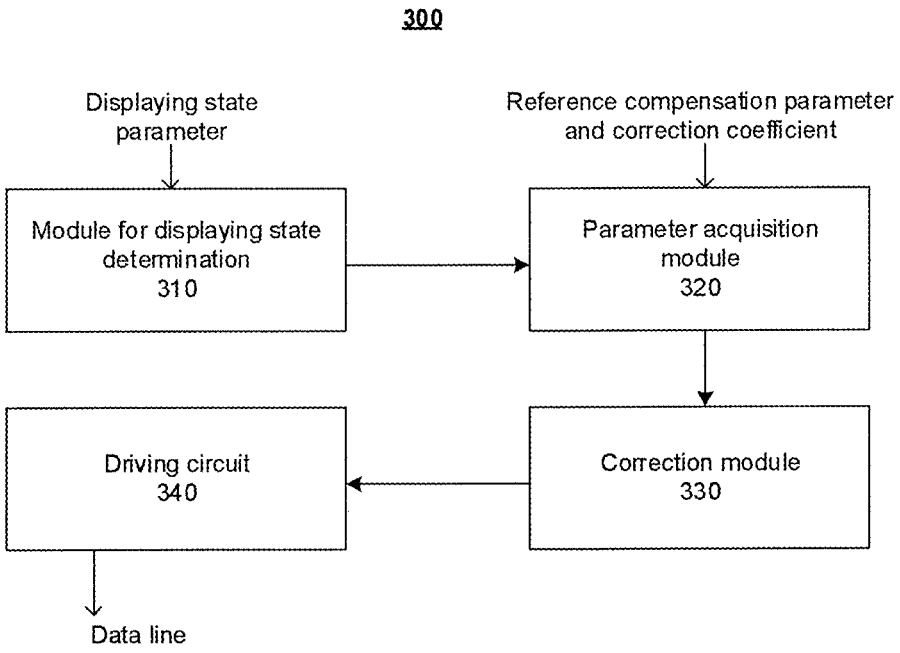
FIG. 3 shows an example structural block diagram illustrating a driving unit for the display panel in accordance with an embodiment of the present disclosure.

FIG. 3 shows an example structural block diagram illustrating a driving unit 300 for the display panel in accordance with an embodiment of the present disclosure.

As shown in FIG. 3, the driving unit 300 may include a module for displaying state determination 310, a parameter acquisition module 320, a correction module 330, and a driving circuit 340. The module for displaying state determination 310 is configured to determine the displaying state according to the displaying state parameter of the display panel. The parameter acquisition module 320 is configured to acquire a reference compensation parameter and a correction coefficient for a target displaying state, in response to determining that the displaying state is the target displaying state. The correction module 330 is configured to determine a corrected compensation parameter for the target displaying state, based on the reference compensation parameter and the correction coefficient for the target displaying state. The drive circuit 340 is configured to compensate display brightness of pixels on the display panel, by using the corrected compensation parameter. In some embodiments, the driving unit may further include a pre-determination module for pre-determining the reference compensation parameter and the correction coefficient for the target displaying state.

The driving unit 300 can be used to perform the method 200 as shown in FIG. 2. Therefore, the explanations and illustrations made above in connection with FIG. 2 are equally applicable herein and will not be described again.

Figure 4:
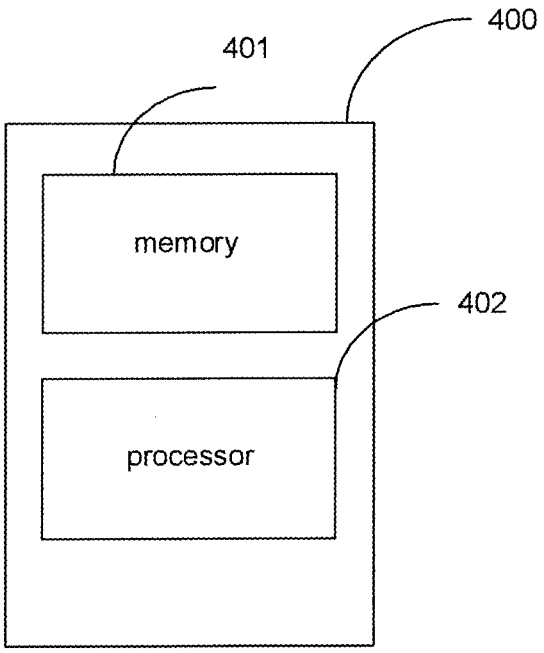
FIG. 4 shows another example structural block diagram illustrating the driving unit for the display panel in accordance with an embodiment of the present disclosure.

FIG. 4 shows another example structural block diagram illustrating the driving unit for the display panel in accordance with an embodiment of the present disclosure. As shown in FIG. 4, the driving unit 400 for the display panel according to an embodiment of the present disclosure may include a memory 401 configured to store instructions; at least one processor 402 coupled to the memory electrically and configured to execute instructions stored in the memory to determine a displaying state according to a displaying state parameter of the display panel; acquire a reference compensation parameter and a correction coefficient for a target displaying state, in response to determining that the displaying state is the target displaying state; determine a corrected compensation parameter for the target displaying state, based on the reference compensation parameter and the correction coefficient for the target displaying state; and compensate the display brightness of pixels on the display panel, by using the corrected compensation parameter.

The processor in driving unit 400 can be configured to perform method 200 as shown in FIG. 2. Therefore, the explanations and illustration made above in connection with FIG. 2 are equally applicable herein and will not be described again.

Figure 5:
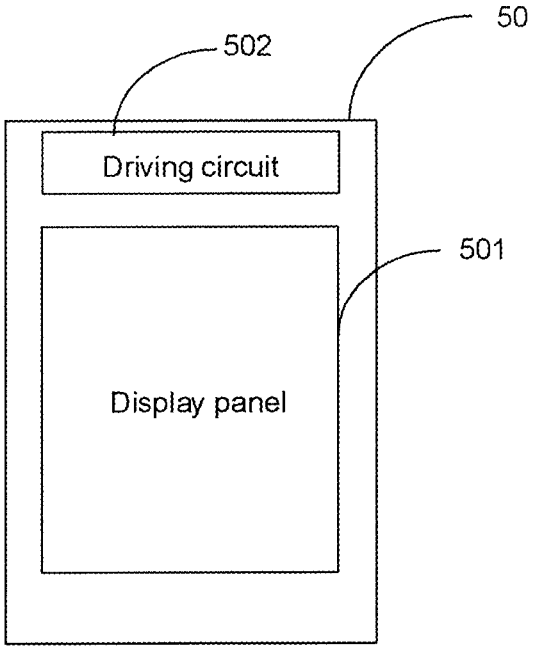
FIG. 5 shows a structural block diagram illustrating a display device in accordance with an embodiment of the present disclosure.

In addition, the embodiments of the present disclosure further propose a display device. FIG. 5 shows a structural block diagram illustrating a display device in accordance with an embodiment of the present disclosure. As shown in FIG. 5, the display device 50 includes a display panel 501; and a driving unit 502 according to any of the above embodiments (e.g., the driving unit 300 and the driving unit 400). The driving unit is electrically coupled to the display panel.

Specifically, the display device may be any product or component having a display function, such as an electronic paper, a mobile phone, a tablet computer, a television, a display, a notebook computer, a digital photo frame, a navigator, and the like.

The present disclosure has been described with reference to a few exemplary embodiments. It is understood that the terms used herein are illustrative and exemplary, but not restrictive. The present disclosure may be embodied in a variety of forms without departing from the spirit or scope of the disclosure. It is also understood that the above-described embodiments are not limited to the details discussed above, but are construed broadly within the spirit and scope defined by the appended claims. All changes and modifications that fall within the scope of the claims or the equivalents thereof are intended to be covered by the appended claims.

We claim:

1. A method of compensating in a display panel, comprising:

determining a displaying state according to a displaying state parameter of the display panel;

acquiring a reference compensation parameter and a correction coefficient for a target displaying state, in response to determining that the displaying state is the target displaying state;

determining a corrected compensation parameter for the target displaying state, based on the reference compensation parameter and the correction coefficient for the target displaying state; and compensating display brightness of pixels on the display panel, by using the corrected compensation parameter, wherein: the acquiring the correction coefficient for the target displaying state further comprises:

selecting N representative display panels from a plurality of display panels having the same production batch as the display panel, wherein N being an integer greater than one;

determining the reference compensation parameter for each of the N representative display panels, under a reference displaying state;

determining a target compensation parameter for each of the N representative display panels, under the target displaying state; and acquiring the correction coefficient for the target displaying state via a fitting operation, according to the reference compensation parameters and the target compensation parameters for the N representative display panels;

wherein acquiring the correction coefficient for the target displaying state via the fitting operation further comprises: performing the fitting operation to acquire the correction coefficients c, d, e, and f, by:

$$a_{ij}'=c\cdot a_{ij}+d,\ b_{ij}'=e\cdot b_{ij}+f$$

wherein, $a_{ij}$ and $b_{ij}$ are the reference compensation parameters at a $j^{th}$ position to be compensated on an $i^{th}$ representative display panel among the N representative display panels determined under the reference displaying state, i is an integer being greater than or equal to 1 and being less than or equal to N, j is an integer being greater than or equal to 1; $a_{ij}'$ and $b_{ij}'$ are the target compensation parameters at the $j^{th}$ position to be compensated on the $i^{th}$ representative display panel among the N representative display panels determined under the target displaying state;

wherein determining the corrected compensation parameter for the target displaying state based on the reference compensation parameter and the correction coefficient comprises:

determining, for respective position to be compensated on the display panel, the corrected compensation parameters a' and b' for the target displaying state, by:

$$a'=c\cdot a+d,\ b'=e\cdot b+f$$

wherein a and b are the reference compensation parameters for the respective position to be compensated;

wherein compensating display brightness of pixels on the display panel, by using the corrected compensation parameter comprises: compensating the display brightness for the respective position to be compensated by:

$$y=a_j'x+b_j',$$

wherein x is an input gray scale value, y is an output gray scale value, and $a_j$ and $b_j$ are the corrected compensation parameters at the $j^{th}$ position to be compensated on the display panel.

2. The method of claim 1, wherein acquiring the reference compensation parameter comprises:

capturing an image displayed on the display panel under the reference displaying state;

determining positions to be compensated based on the image;

determining the reference compensation parameter for each of the positions to be compensated;

storing the reference compensation parameter.

3. The method of claim 1, wherein the displaying state parameter comprises a refresh rate.

4. The method of claim 1, wherein acquiring the reference compensation parameter and the correction coefficient for the target displaying state comprises: fetching the reference compensation parameter and the correction coefficient from a storage unit of the display panel.

5. A driving unit for a display panel, comprising:

a memory configured to store instructions;

at least one processor coupled to the memory electrically and configured to execute instructions stored in the memory to:

determine a displaying state according to a displaying state parameter of the display panel;

acquire a reference compensation parameter and a correction coefficient for a target displaying state, in response to determining that the displaying state is the target displaying state;

determine a corrected compensation parameter for the target displaying state, based on the reference compensation parameter and the correction coefficient for the target displaying state; and compensate display brightness of pixels on the display panel, by using the corrected compensation parameter;

wherein the processor is further configured to acquire the correction coefficient for the target displaying state in advance by:

selecting N representative display panels from a plurality of display panels having the same production batch as the display panel, wherein N being an integer greater than one;

determining the reference compensation parameter for each of the N representative display panels, under a reference displaying state;

determining a target compensation parameter for each of the N representative display panels, under the target displaying state; and acquiring the correction coefficient for the target displaying state via a fitting operation, according to the reference compensation parameters and the target compensation parameters for the N representative display panels;

wherein the processor is further configured to perform the fitting operation to acquire the correction coefficients c, d, e, and f, by:

$$a_{ij}'=c\cdot a_{ij}+d,\ b_{ij}'=e\cdot b_{ij}+f$$

wherein, $a_{ij}$ and $b_{ij}$ are the reference compensation parameters at a $j^{th}$ position to be compensated on an $i^{th}$ representative display panel among the N representative display panels determined under the reference displaying state, i is an integer being greater than or equal to 1 and being less than or equal to N, j is an integer being greater than or equal to 1; $a_{ij}'$ and $b_{ij}'$ are the target compensation parameters at the $j^{th}$ position to be compensated on the $i^{th}$ representative display panel among the N representative display panels determined under the target displaying state;

wherein the processor is further configured to determine, for respective position to be compensated on the display panel, the corrected compensation parameters a' and b' for the target displaying state, by:

$$a'=c\cdot a+d,\ b'=e\cdot b+f$$

wherein a and b are the reference compensation parameters for the respective position to be compensated;

wherein the processor is further configured to compensate the display brightness for the respective position to be compensated, by:

$$y=a_j'x+b_j'$$

wherein x is an input gray scale value, y is an output gray scale value, and $a_j$ and $b_j$ are the corrected compensation parameters at the $j^{th}$ position to be compensated on the display panel.

6. The driving unit of claim 5 wherein the processor is further configured to:

capture an image displayed on the display panel under the reference displaying state;

determine positions to be compensated based on the image;

determine the reference compensation parameter for each of the positions to be compensated; and store the reference compensation parameter.

7. The driving unit of claim 5, wherein the processor is further configured to fetch the reference compensation parameter and the correction coefficient from a storage unit of the display panel.

8. A driving unit for a display panel, comprising:

a module for displaying state determination, configured to determine a displaying state according to a displaying state parameter of the display panel;

a parameter acquisition module, configured to acquire a reference compensation parameter and a correction coefficient for a target displaying state, in response to determining that the displaying state is the target displaying state;

a correction module, configured to determine a corrected compensation parameter for the target displaying state, based on the reference compensation parameter and the correction coefficient for the target displaying state; and a driving circuit, configured to compensate display brightness of pixels on the display panel, by using the corrected compensation parameter;

the parameter acquisition module is further configured to acquire the correction coefficient for the target displaying state in advance by:

selecting N representative display panels from a plurality of display panels having the same production batch as the display panel, wherein N being an integer greater than one;

determining the reference compensation parameter for each of the N representative display panels, under a reference displaying state;

determining a target compensation parameter for each of the N representative display panels, under the target displaying state; and acquiring the correction coefficient for the target displaying state via a fitting operation, according to the reference compensation parameters and the target compensation parameters for the N representative display panels;

wherein the parameter acquisition module is further configured to perform the fitting operation to acquire the correction coefficients c, d, e, and f, by:

$$a_{ij}'=c\cdot a_{ij}+d,\ b_{ij}'=e\cdot b_{ij}+f$$

wherein, $a_{ij}$ and $b_{ij}$ are the reference compensation parameters at a $j^{th}$ position to be compensated on an $i^{th}$ representative display panel among the N representative display panels determined under the reference displaying state, i is an integer being greater than or equal to 1 and being less than or equal to N, j is an integer being greater than or equal to 1; $a_{ij}'$ and $b_{ij}'$ are the target compensation parameters at the $j^{th}$ position to be compensated on the $i^{th}$ representative display panel among the N representative display panels determined under the target displaying state;

wherein the parameter acquisition module is further configured to determine, for respective position to be compensated on the display panel, the corrected compensation parameters a' and b' for the target displaying state, by:

$$a'=c\cdot a+d,\ b'=e\cdot b+f$$

wherein a and b are the reference compensation parameters for the respective position to be compensated;

wherein the parameter acquisition module is further configured to compensate the display brightness for the respective position to be compensated, by:

$$y=a_j'\cdot x+b_j'$$

wherein x is an input gray scale value, y is an output gray scale value, and $a_j$ and $b_j$ are the corrected compensation parameters at the $j^{th}$ position to be compensated on the display panel.

9. A display device comprising:

a display panel; and a driving unit for the display panel, comprising:

a memory configured to store instructions;

at least one processor coupled to the memory electrically and configured to execute instructions stored in the memory to:

determine a displaying state according to a displaying state parameter of the display panel;

acquire a reference compensation parameter and a correction coefficient for a target displaying state, in response to determining that the displaying state is the target displaying state;

determine a corrected compensation parameter for the target displaying state, based on the reference compensation parameter and the correction coefficient for the target displaying state; and compensate display brightness of pixels on the display panel, by using the corrected compensation parameter;

wherein the processor is further configured to acquire the correction coefficient for the target displaying state in advance by:

selecting N representative display panels from a plurality of display panels having the same production batch as the display panel, wherein N being an integer greater than one;

determining the reference compensation parameter for each of the N representative display panels, under a reference displaying state;

determining a target compensation parameter for each of the N representative display panels, under the target displaying state; and acquiring the correction coefficient for the target displaying state via a fitting operation, according to the reference compensation parameters and the target compensation parameters for the N representative display panels;

wherein the processor is further configured to perform the fitting operation to acquire the correction coefficients c, d, e, and f, by:

$$a_{ij}'=c\cdot a_{ij}+d,\ b_{ij}'=e\cdot b_{ij}+f$$

wherein, $a_{ij}$ and $b_{ij}$ are the reference compensation parameters at a $j^{th}$ position to be compensated on an $i^{th}$ representative display panel among the N representative display panels determined under the reference displaying state, i is an integer being greater than or equal to 1 and being less than or equal to N, j is an integer being greater than or equal to 1; $a_{ij}'$ and $b_{ij}'$ are the target compensation parameters at the $j^{th}$ position to be compensated on the $i^{th}$ representative display panel among the N representative display panels determined under the target displaying state;

wherein the processor is further configured to determine, for respective position to be compensated on the display panel, the corrected compensation parameters a' and b' for the target displaying state, by:

$$a'=c\cdot a+d,\ b'=e\cdot b+f$$

wherein a and b are the reference compensation parameters for the respective position to be compensated;

wherein the processor is further configured to compensate the display brightness for the respective position to be compensated, by:

$$y=a_j'\cdot x+b_j'$$

wherein x is an input gray scale value, y is an output gray scale value, and $a_j$ and $b_j$ are the corrected compensation parameters at the $j^{th}$ position to be compensated on the display panel, wherein the driving unit is electrically connected to the display panel.

* * * * *